US010905215B1

(12) United States Patent
Silva

(10) Patent No.: US 10,905,215 B1
(45) Date of Patent: Feb. 2, 2021

(54) HEADBAND STYLING TOOL

(71) Applicant: David Silva, Reno, NV (US)

(72) Inventor: David Silva, Reno, NV (US)

( * ) Notice: Subject to any disclaimer, the term of this patent is extended or adjusted under 35 U.S.C. 154(b) by 223 days.

(21) Appl. No.: 15/644,804

(22) Filed: Jul. 9, 2017

Related U.S. Application Data

(60) Provisional application No. 62/360,425, filed on Jul. 10, 2016.

(51) Int. Cl.
*A45D 8/36* (2006.01)

(52) U.S. Cl.
CPC ..... *A45D 8/36* (2013.01)

(58) Field of Classification Search
CPC ..... A45D 2008/004; A45D 2008/006; A45D 8/36; A45D 5/0073; A45D 2007/004; A45D 2002/007; A45D 8/00; A45D 8/12; A45D 24/04; A41G 5/0093; A41D 20/00; A41D 23/00
USPC ..... 132/54, 55, 273, 274
See application file for complete search history.

(56) References Cited

U.S. PATENT DOCUMENTS

D36,683 S * 12/1903 Kingman ..... D28/33
749,533 A * 1/1904 Cummins ..... A45D 8/12 132/106
794,479 A * 7/1905 Austin ..... A41G 5/0073 132/105
942,833 A * 12/1909 Latsch ..... A41G 3/0041 132/54
2,474,148 A * 6/1949 Horton ..... A45D 8/38 132/55
5,890,494 A * 4/1999 Sonstegard ..... A45D 2/40 132/246
D497,467 S * 10/2004 Srivastava ..... D2/894
7,798,155 B2 * 9/2010 Schweers ..... A42C 5/00 132/273
8,517,033 B2 * 8/2013 Martinelli ..... A45D 8/38 132/106
D717,489 S * 11/2014 Haas ..... D28/10
2005/0061345 A1 * 3/2005 Srivastava ..... A45D 8/34 132/200
2009/0183751 A1 * 7/2009 Tu ..... A45D 8/36 132/273
2011/0000499 A1 * 1/2011 Hsu ..... A45D 8/12 132/219
2011/0186073 A1 * 8/2011 Hsu ..... A45D 8/00 132/275
2012/0090635 A1 * 4/2012 Hsu ..... A45D 8/12 132/275
2013/0233334 A1 * 9/2013 Kaminski ..... A45D 8/00 132/210
2015/0013710 A1 * 1/2015 Buzaglo ..... A41G 5/0093 132/201

* cited by examiner

*Primary Examiner* — Amy R Weisberg

(57) ABSTRACT

A hairstyling headband that has an elongated channel along its center creating two tiers. The back tier is raised so hair can be placed into the channel and fanned out along the channel covering the raised portion to create 1960's inspired bumped up hair style behind the front tier. Hair can also be placed between a two-tiered headband and rolled up until the headband is secured to the head, creating a rolled hairstyle, and curls when the headband is removed.

3 Claims, 3 Drawing Sheets

HEADBAND STYLING TOOL

BACKGROUND OF THE INVENTION

1. Field of the Invention

The present invention and methods relate to a hair styling device. More particularly, to a double tiered headband for styling hair.

2. Description of Prior Art

Headbands are useful for holding hair back, however, the present invention enables a person to create multiple hairstyles using a double headband—such as creating a bumped hairstyle, rolled hairstyle, or curls.

SUMMARY OF THE PRESENT INVENTION

An object of the present invention is to provide an instrument that is convenient, practical, and inexpensive for use in hair styling.

A further object is to provide an instrument that will stay in place after the hairstyle is created.

A further object is to provide a double tiered headband that is raised on one tier.

A further object is to provide a double tiered headband that is raised on one tier for bumping up a hairstyle, eliminating the traditional backcombing needed to create the style.

A further object is to provide a double tiered headband that is rolled up to style or curl hair.

A further object is to provide such an instrument that can be used unassisted by the individual styling their hair, eliminating the expense of a professional stylist.

A further object is to provide a double tiered headband that can hold and roll all the users hair into a rolled hairstyle.

A further object is to provide a double tiered headband that can be reused.

A further object is to provide a double tiered headband that will quickly style and hold the user's hair up in a neatly secured position.

According to one aspect of the present invention, there is provided a double tiered headband with one of the tiers raised higher than the other. The preferred headband is a substantially rigid headband. The raised tier of the headband enables the user to bump up the hair using the back tier hidden under the hair, while using the front as a standard headband.

According to the arrangement described above, the semicircle headband can be placed around a portion of the user's hair by gathering hair and placing it between the two tiers. The user can then place the headband on the head as one would with a regular headband, and spread the hair that was placed between the two tiers, over the top of the raised tier portion. The finished style puts the perfect 1960's Bridgette Bardot inspired bump in back with the raised tier portion hidden under the hair, raising it, while the front tier looks like a single headband on the head. The raised tier portion could be closely snug to the front tier to pinch the hair between the two tiers, to keep the raised hair in place. An additional non-slip material could be placed on the raised portion, such as silicone or hook and loop material, to help keep the hair in place.

Accordingly, a preferred embodiment, each headband tier is plastic and integrally connected at each end. The raised portion is foam, but could be any type of material, including a hair weft (either real hair or synthetic hair), hook and loop material, fabric, silicone, or more plastic.

Another way to use the invention is to place the hair between the two tiers by gathering hair, placing the hair between the two tiers, rolling the headband toward the head, and then placing the headband on head. Both tiers become completely hidden in the hair and the finished result is a rolled hairstyle. This can be done with some of the hair to form a half up-do, or with all the hair to form a rolled up-do. This technique can be used to curl the hair as well.

Other objects, features and advantages of the present invention will become apparent from the following description of the preferred embodiments given with reference to the accompanying drawings.

BRIEF DESCRIPTION OF THE DRAWINGS

In the accompanying drawings

PREFERRED EMBODIMENTS

Figure 1:
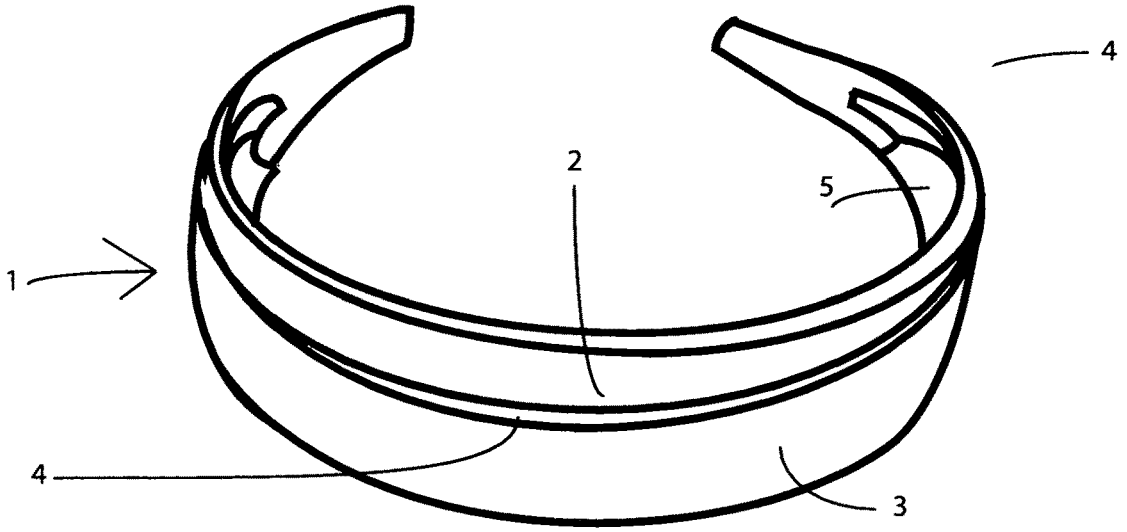
FIG. 1 is a plan view showing the hairstyling headband according to the present invention.

Referring to FIG. 1 of the accompanying drawings, there is illustrated a substantially rigid semicircle hairstyling headband, generally designated by reference numeral 1, embodying the present invention. The hairstyling headband 1 comprises a first front tier 2 and a second back tier 3. The first front tier 2 and the second back tier 3 form an elongated hair receiving slit/opening/grove 4. The second back tier 3 is raised with foam 5.

Figure 2:
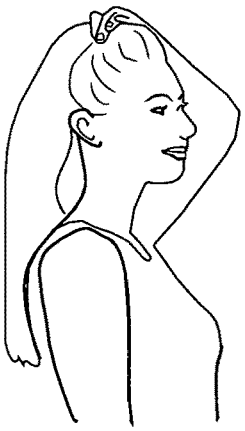
FIG. 2 and FIG. 3 is a schematic view showing the hair gathered and placed between the two tiers.
Figure 3:
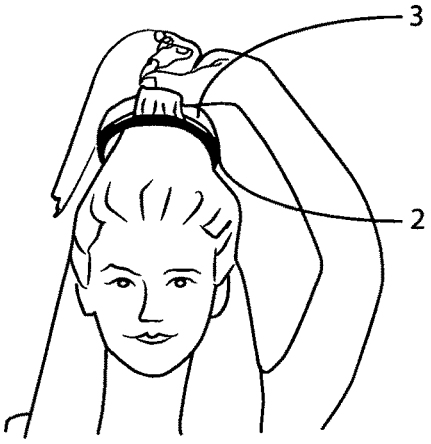
Figure 4:
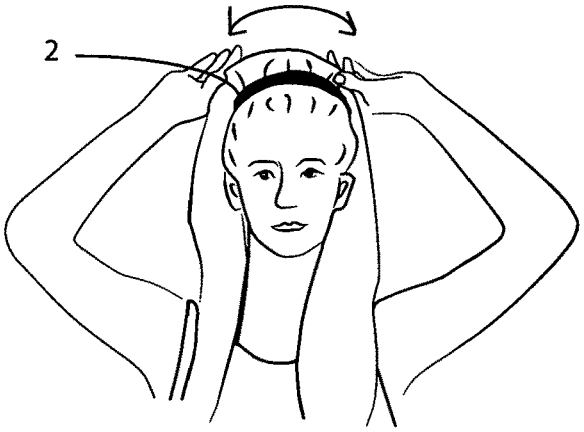
FIG. 4 and FIG. 5 is a schematic view showing the headband placed on the head.
Figure 5:
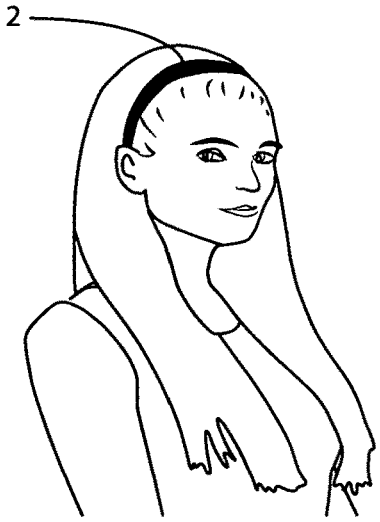
Figure 6:
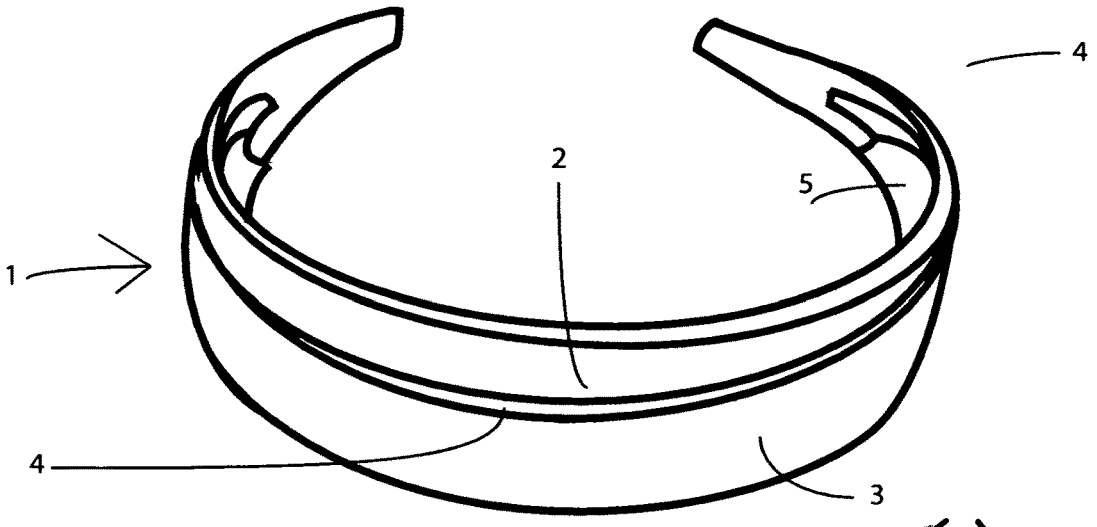
FIG. 6 is a plan view showing the same hairstyling headband according to the present invention.
Figure 7:
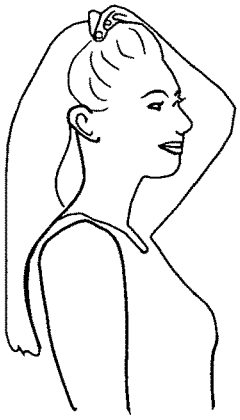
FIG. 7 and FIG. 8 is a schematic view showing the hair gathered and placed between the two tiers.
Figure 8:
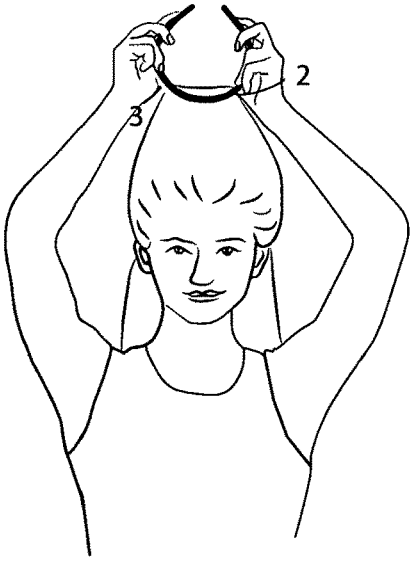
Figure 9:
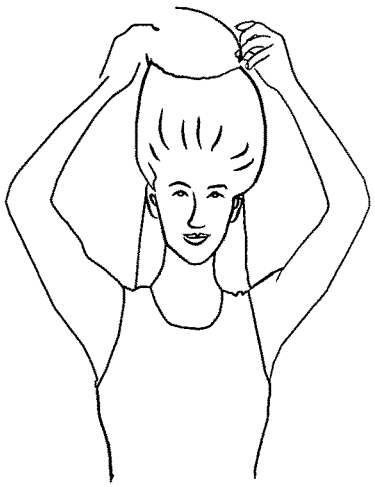
FIG. 9 is a schematic view showing the headband being rolled up.
Figure 10:
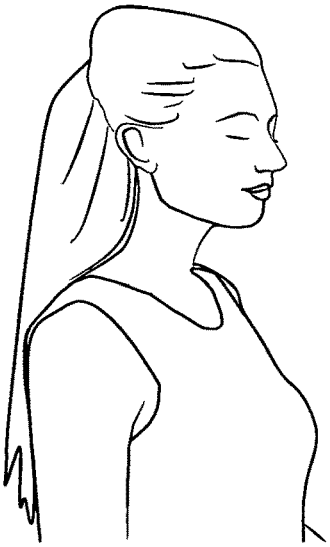
FIG. 10 is a schematic view showing the headband placed on the head.

In use FIG. 2 through FIG. 5 hair from the front of the head is gathered FIG. 2 and placed between the first tier 2 and the second tier 3 FIG. 3. The headband is place on top of the head FIG. 4. The hair is fanned to cover the back tier 3 and foam 5 FIG. 5. In another use FIG. 6 through FIG. 10 hair is gathered FIG. 7 and placed between the first tier 2 and the second tier 3 FIG. 8. The headband 1 is rolled up FIG. 9 and then placed on the head FIG. 10.

Figure 11:
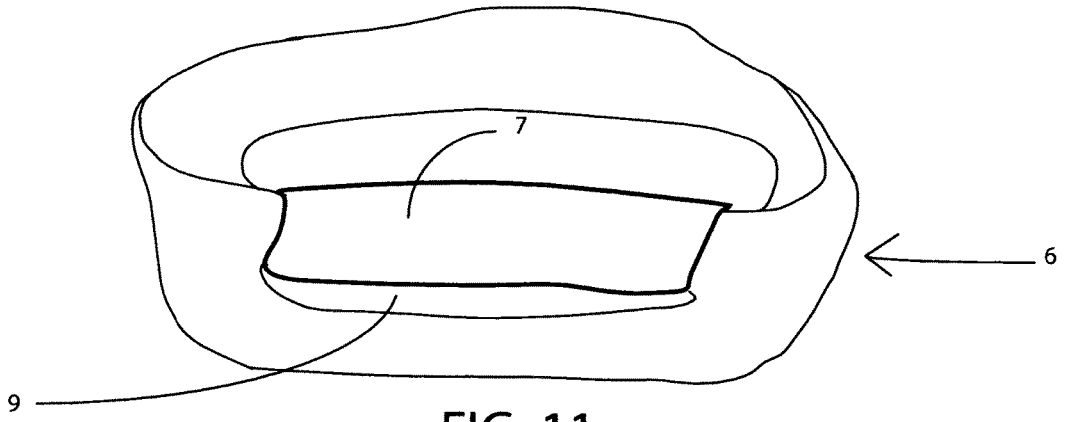
FIG. 11 is a plan view showing the hairstyling headband according to the present invention with a full circular headband.

Referring to FIG. 11 of the accompanying drawings, there is illustrated another embodiment of the current invention 6, embodying the present invention. The headband is a circular headband 6 which does not need to be rigid because it is held in place by placing completely around the user's head. The headband 6 has a back padded tier 7—which forms an elongated hair receiving opening/slit/channel 9.

Figure 12:
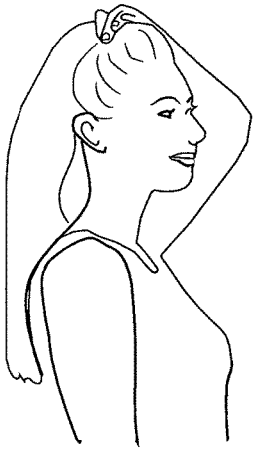
FIG. 12 and FIG. 13 is a schematic view showing the hair gathered and placed into the grove, between the headband and back tier.
Figure 13:
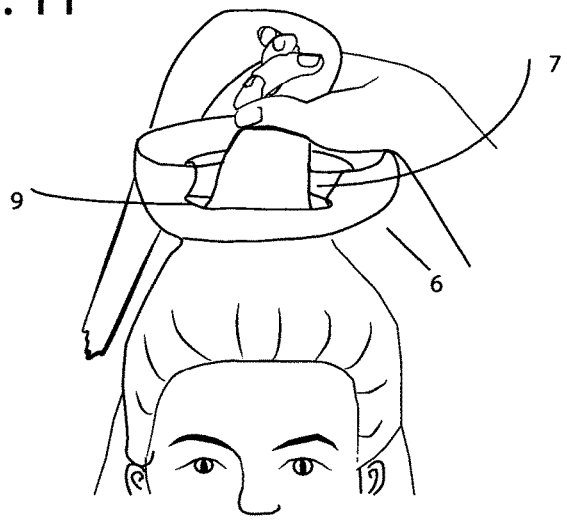
Figure 14:
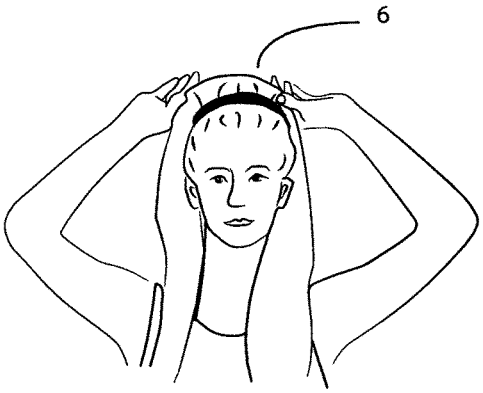
FIGS. 14 and 15 is a schematic view showing the headband placed around the head and fanned.
Figure 15:
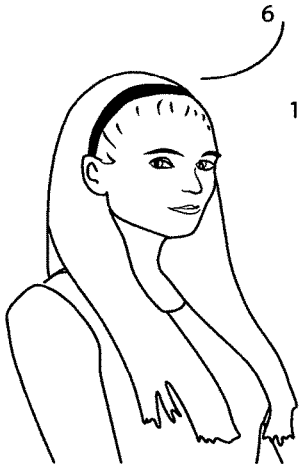

In use FIG. 12 through FIG. 15 a portion of hair is gathered FIG. 12 and placed into the hair receiving opening 9 FIG. 13. The circular headband 6 is place around the head and the hair in the opening is fanned FIG. 14 and FIG. 15.

The present invention being thus described, the same may be varied in many ways. For instance, the device can be made of any material. The plastic and padded portions can be covered in fabric. The headband method can start by placing the headband around the head in a traditional fashion and then pulling the hair that the user wants bumped up, through the opening/slit/channel. The raised back tier could be hook and loop material, no slip material, or raised textured plastic. It could also be a long hair weft that could not only bump the hair, but be a terrific way for the user's hair to look longer and thicker. There could be a third back tier so the user can weave the hair through the first opening, over the second tier, and into the second opening. Whereby the first tier and back tier look like headbands and the center bumps the hair. Further, any way to use the present invention obvious in the art should apply.

Figure 16:
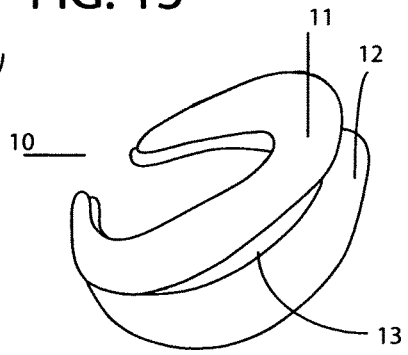
FIG. 16 is another version showing the semicircle headband with both tiers padded.

Referring to FIG. 16 of the accompanying drawings, there is illustrated a substantially rigid semicircle hairstyling headband, generally designated by reference numeral 10, embodying the present invention. The hairstyling headband 10 comprises a first front padded tier 11 and a second padded back tier 12. The first front tier 11 and the second back tier 12 form an elongated hair receiving slit/opening/grove 13.

I claim:

1. A hairstyling headband comprising:

a semicircle plastic headband having a front tier and a back tier integrally connected to one another creating a channel between the front tier and the back tier;

wherein the back tier is raised higher than the front tier and the back tier further comprises hook material configured to hold hair of a user in place;

said headband configured to be placed on a head of a user after the user pulls a portion of the hair through the channel; and said raised portion of said back tier configured to be hidden under the hair and to provide a bumped hairstyle.

2. A method of styling hair comprising:

selecting the hairstyling headband of claim 1;

placing hair in said channel; placing the headband on the head; and fanning the hair to cover the back tier.

3. A method of styling hair comprising:

selecting the hairstyling headband of claim 1;

placing hair in said channel;

rolling the hair in said channel up like a roller; and placing the headband on the head.

* * * * *